US006084169A

United States Patent [19]

Hasegawa et al.

[11] Patent Number: 6,084,169

[45] Date of Patent: Jul. 4, 2000

[54] AUTOMATICALLY COMPOSING BACKGROUND MUSIC FOR AN IMAGE BY EXTRACTING A FEATURE THEREOF

[75] Inventors: Takashi Hasegawa, Hachioji; Yoshinori Kitahara, Tachikawa, both of Japan

[73] Assignee: Hitachi, Ltd., Tokyo, Japan

[21] Appl. No.: 09/254,485

[22] PCT Filed: Sep. 13, 1996

[86] PCT No.: PCT/JP96/02635

§ 371 Date: Mar. 9, 1999

§ 102(e) Date: Mar. 9, 1999

[87] PCT Pub. No.: WO98/11529

PCT Pub. Date: Mar. 19, 1998

[51] Int. Cl.[7] ..... G10H 1/40

[52] U.S. Cl. ..... 84/600; 84/636; 84/668; 84/477 R; 84/DIG. 12

[58] Field of Search ..... 84/600–607, 609–614, 84/622–625, 634–638, 649–652, 659–661, 666–669, DIG. 12, 477 R, 478

[56] References Cited

U.S. PATENT DOCUMENTS 5,159,140 10/1992 Kimpara et al. ..... 84/600

FOREIGN PATENT DOCUMENTS 60-40027 9/1985 Japan .
64-70797 3/1989 Japan .
4-111181 4/1992 Japan .
6-124082 5/1994 Japan .
6-186958 7/1994 Japan .
9-81141 3/1997 Japan .

OTHER PUBLICATIONS

Akio Nagasaka et al., "Automatic Video Indexing and Full–Video Search for Object Appearances," Papers vol. 33, No. 4, *Information Processing Society of Japan*, Apr. 1992.

Jun–Ichi Nakamura, et al. "Automatic Background Music Generation based on Actors' Mood and Motions", *The Journal of Visualization and Computer Animation*, vol. 3, pp. 246–264, 1994.

*Primary Examiner*—Stanley J. Witkowski
*Attorney, Agent, or Firm*—Antonelli, Terry, Stout & Kraus, LLP

[57] ABSTRACT

An automatic music composing method automatically composes background music matching an atmosphere and a reproduction time of an input moving or changing image. A moving or changing image is inputted and divided into scenes, a feature of each scene is extracted, an automatic music composing parameter is obtained from the feature, background music is automatically composed using the parameter and scene reproduction time, and the composed background music is output along with the moving or changing image.

28 Claims, 14 Drawing Sheets

AUTOMATICALLY COMPOSING BACKGROUND MUSIC FOR AN IMAGE BY EXTRACTING A FEATURE THEREOF

BACKGROUND OF THE INVENTION

1. Field of the Invention

The present invention relates to an automatic music composing method for automatically composing background music for an input image. More specifically, the invention relates to an automatic music composing method and system for analyzing an input image and automatically composing music which matches the atmosphere of the input image and continues during the period while the image is displayed.

2. Description of the Related Art

A conventional method of generating background music for an image is, for example, "Automatic Background Music Generation based on Actors' Mood and Motion" described in The Journal of Visualization and Computer Animation, Vol. 5, pp. 247–264 (1994). According to this conventional technology, a user enters for each scene of a moving image of computer animation a mood type representative of the atmosphere of each scene and a reproduction time of each scene, and in accordance with the entered atmosphere and time, background music is generated and added to the moving image. In many cases, producers add background music to animation, movies, and the like by themselves. In this case, the atmosphere suitable for each scene and the time of each scene are usually predetermined during the production process. It is therefore easy to know the conditions to be supplied to a background music generating system.

However, in the case of a general moving image such as a video image photographed by a common user, which scene is photographed in how many seconds is not predetermined. In adding background music to video images (moving images) photographed by a common user by using the above-described conventional technology, the user must find the division positions of scenes after the video images are photographed and determine the background music generating conditions as to the reproduction time and atmosphere of each scene to supply the conditions to the system. It takes therefore a long time and requires a considerable amount of work.

DISCLOSURE OF THE INVENTION

An object of the invention is to solve the above-mentioned problem and provide an automatic music composing system capable of automatically composing BGM suitable for the atmosphere and reproduction time of a externally supplied moving image, a video editing system including such an automatic music composing system, and a multimedia production generation support system.

The above-mentioned object can be achieved by an automatic music composing method in which a given moving changing image is divided into scenes, a feature of each scene is extracted, the feature is converted into a parameter, and background music is automatically composed by using the parameter and scene reproduction time.

In a background music assigning method according to this invention, a given moving or changing image is divided into scenes, a feature of each scene is extracted, the feature is converted into a parameter to be used for automatic musical performance, background music is automatically composed by using the parameter and scene reproduction time, and background matching an atmosphere and reproduction time of the moving or changing image is outputted, together with the moving or changing image.

DETAILED DESCRIPTION OF THE INVENTION

An embodiment of the invention will be described in detail with reference to the accompanying drawings.

Figure 2:
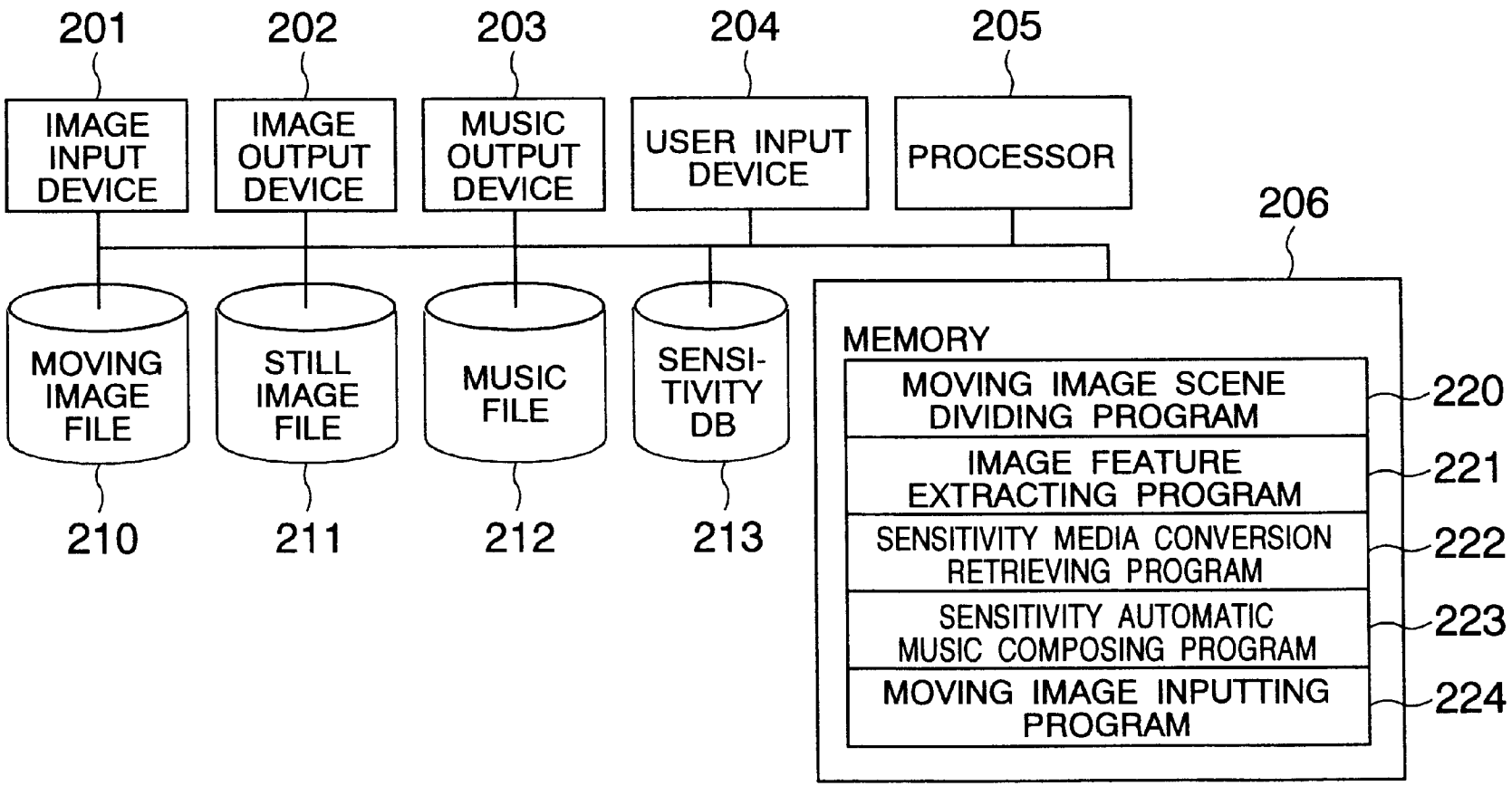
FIG. 2 is a block diagram showing the structure of a system of adding background music to an image according to an embodiment of the invention.

First, the outline of a system structure of this invention will be described in detail with reference to FIG. 2. The system shown in FIG. 2 is constituted of, at least a processor (205) for controlling the whole system, a memory (206,) for storing a system control program (not shown) and various programs executing the invention and a storage area (not shown) to be used when the invention is executed, input/output devices (201–204) for inputting/outputting images, music, acoustics, and voices, and various secondary storage devices (210–213) to be used when the invention is executed.

An image input device (201) enters moving images or still images into dedicated files (210, 211). In practice, the image input device (201) is a video camera or a video reproduction apparatus (for entering moving images), or a scanner or a digital camera (for entering still images). An image output device (202) outputs images and may be a liquid crystal or CRT display, a television or the like. A music output device (203) composes music from note information stored in a music file (212) and may be a music synthesizer or the like.

A user input device (204) is used for a user to enter system control information such as a system set-up instruction and may be a keyboard, a mouse, a touch-panel, a customized command key, a voice input device or the( like.

The memory (206) stores the following programs: a moving image scene dividing program (220) for dividing an input moving image into scenes; an image feature extracting program (221) for extracting a feature of an image; a sensitivity media conversion retrieving program (222) for retrieving musical value trains constituting music matching the atmosphere of an image, by referring to the extracted features; and a sensitivity automatic music composing program (223) for composing music from the retrieved musical value trains. The memory (206) also stores the system control program and has a storage area for storing temporary data obtained during the execution of the above-described programs.

The outline of the processes according to the invention will be described with reference to FIG. 1. After the system is set up, a moving image is entered from the image input device (201) in accordance with a moving image inputting program. The input moving image data is stored in the moving image file (210) (Step 101). Next, by using the moving image scene dividing program (220), the moving image stored in the moving image file (210) is divided into scenes (moving image sections without interception). Scene division position information and image scenes designated by the scene division position information are stored in the still image file (211) as representative image information (Step 102). A representative image is an image at an certain time so that the representative image is processed as a still image and stored in the still image file. Next, by using the image feature extracting program (221), a feature amount of the representative image of each scene is extracted and stored in the memory (206) (Step 103). Next, by using the sensitivity media conversion retrieving program (222), sensitivity information stored in the sensitivity DB (213) is retrieved by using the extracted feature amount as a key, and musical value train aggregation contained in the retrieved sensitivity information is stored in the memory (206) (Step 104). Next, by using the sensitivity automatic music composing program (223), background music is composed in accordance with the obtained musical value train aggregation and scene time information obtained from the division position information stored in the memory (206), and the composed background music is stored in the music file (212) (Step 105). Lastly, the composed background music and the input moving image are output at the same time from the music output device (203) and image output device (202) (Step 106).

Next, the system structure and processes will be described in detail. First, the data structures of the secondary storage devices (210–213) and memory 206 constituting the system will be described.

Figure 3:
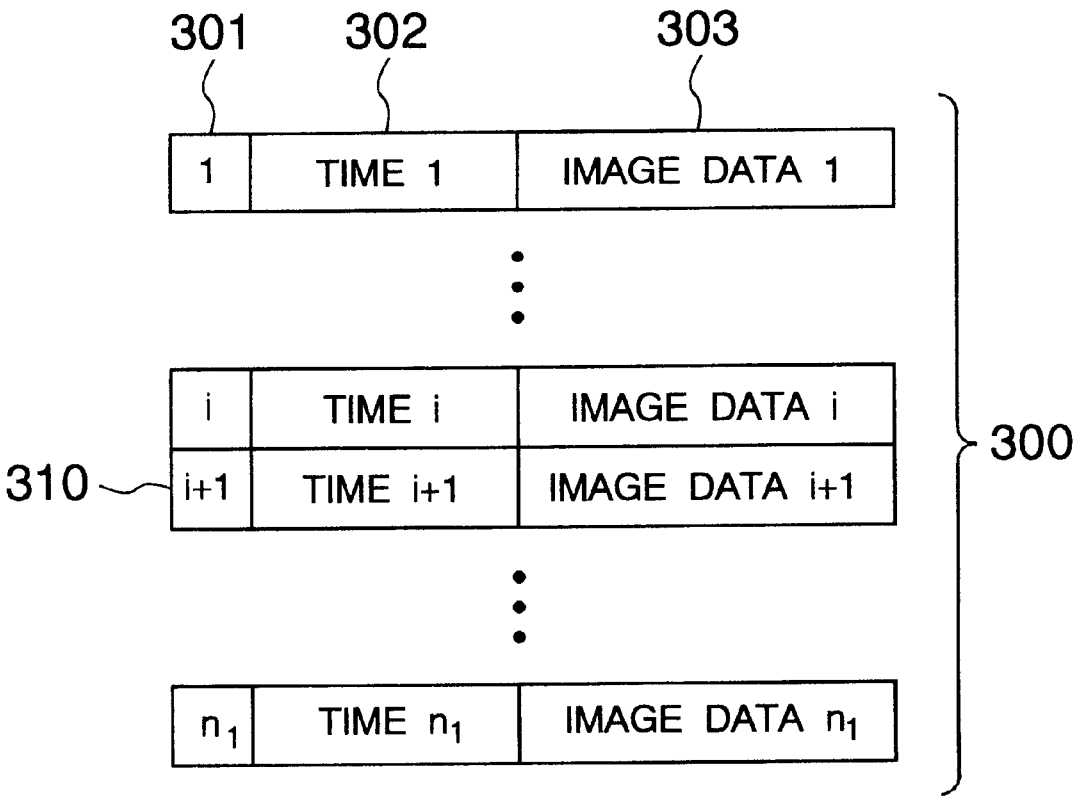
FIG. 3 is an illustrative diagram showing a specific example of moving image data.

FIG. 3 shows the structure of moving image data stored in the moving image file (210) shown in FIG. 2. The moving image data is constituted of a frame data group (300) of a plurality of time sequentially disposed frames. Each frame data is constituted of a number (301) for identifying each frame, a time 302 when the frame is displayed, and image data 303 to be displayed. One moving image is a collection of a plurality of still images. Namely, each image data (303) corresponds to image data of one still image. The moving image is configured by sequentially displaying frame data starting from the image data of the frame number "1". The display time of image data of each frame is stored in the time information (302), by setting "0" to the time (time 1) when the image data of the frame number "1" is displayed. The example shown in FIG. 3 indicates that the input moving images are constituted of n1 frames. For example, the moving images of 30 frames per second have n1=300 during 10 seconds.

Figure 4:
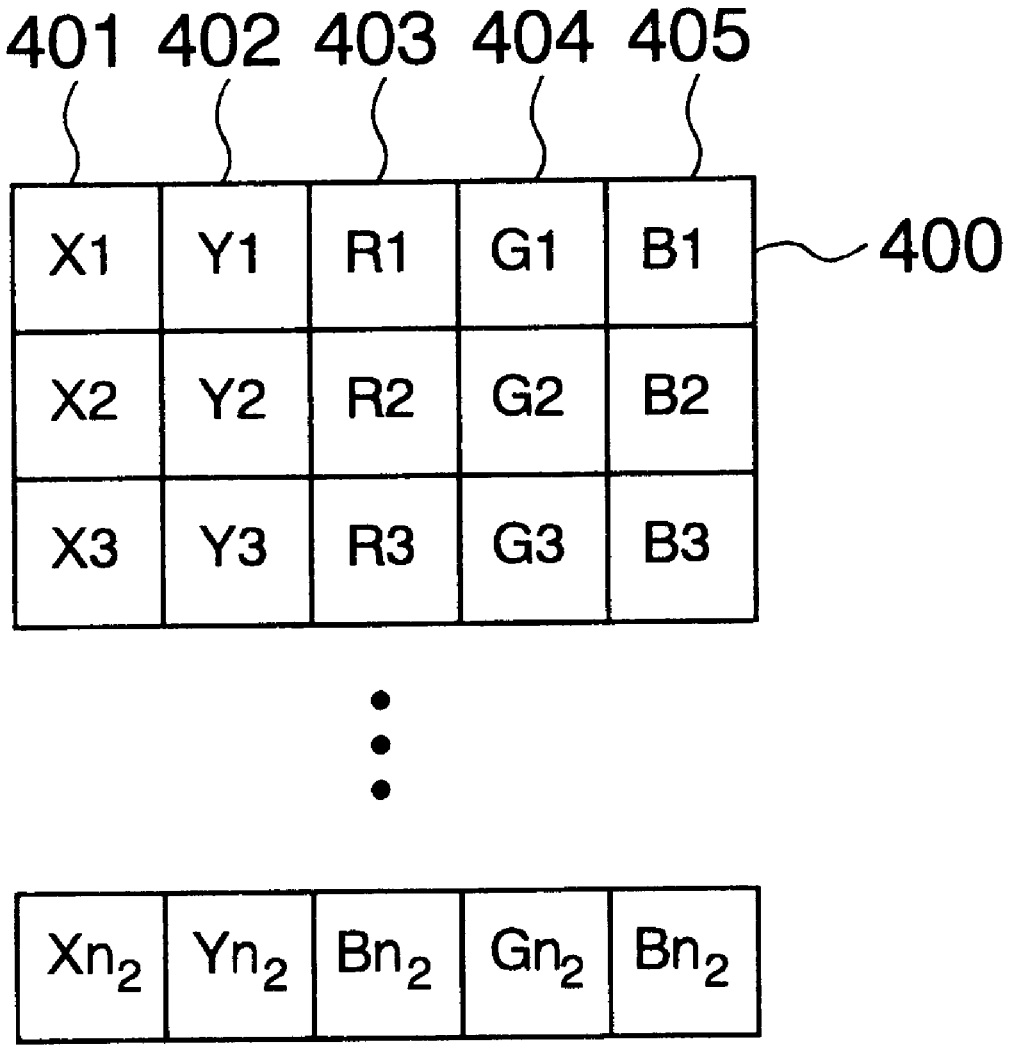
FIG. 4 is an illustrative diagram showing specific examples of image data and still image data contained in moving image data.

The data structures of the still image file (211) shown in FIG. 2 and the image data (303) shown in FIG. 3 will be described in detail with reference to FIG. 4. This data is constituted of display information 400 of all points on an image plane to be displayed at a certain time (e.g., 302) in the time frames shown in FIG. 3. Namely, the display information shown in FIG. 4 exists for the image data at an arbitrary time ni shown in FIG. 3. The display information (400) of each point on an image is constituted of an X-coordinate 401 and a Y-coordinate 402 respectively of the point, and a red intensity 403, a green intensity 404, and a blue intensity 405 respectively as the color information of the point. Since all colors can be expressed generally by using red, green and blue intensities, this data can express the image information which is a collection of points. The color intensity is represented by a real number from 0 to 1. For example, white can be represented by (1, 1, 1) of (red, green, blue), red can be represented by (1, 0, 0), and grey can be represented by (0.5, 0.5, 0.5). In the example shown in FIG. 4, the display information of points is n2 in total number. For an image of 640×800 dots, the display information of points is n2=512,000 in total.

Figure 5:
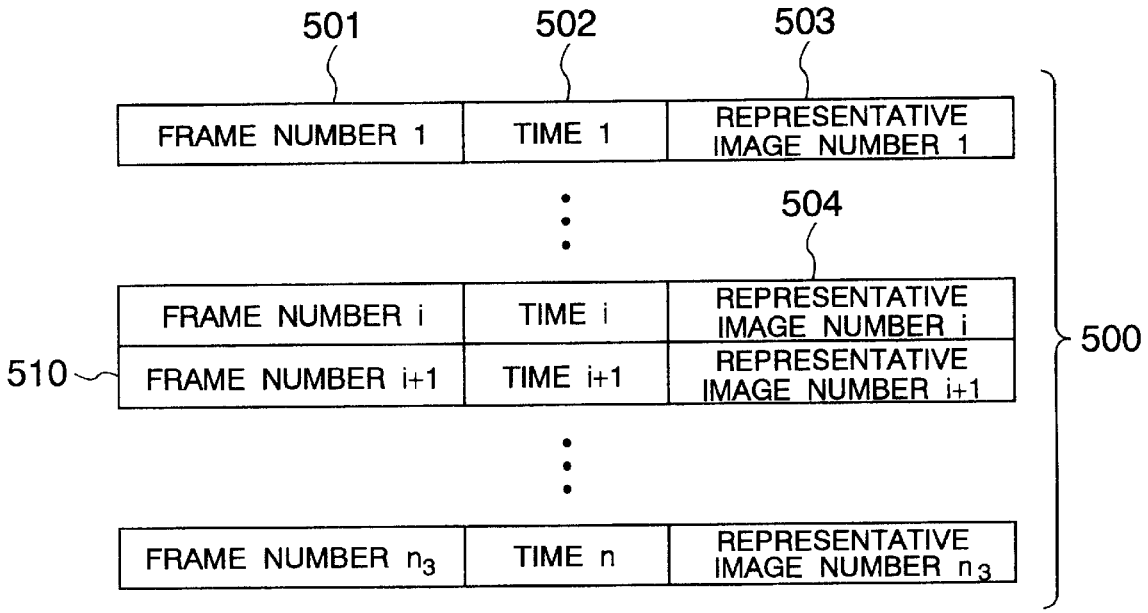
FIG. 5 is an illustrative diagram showing a specific example of scene information train data.

Next, the data structure of the scene information train stored in the memory (206) by the moving image scene division process (102) shown in FIG. 1 will be described in detail with reference to FIG. 5. This data is constituted of scene information 500 of one or more time sequentially disposed scenes. Each scene information is constituted of a frame number (which is often the first frame number of the scene) 501, a time 502 assigned to the frame number (501), and a representative image number 503 of the scene. The scene, e.g. of the scene information 504, corresponds to a moving image section from the frame number i of the moving image to the frame one frame before that of the frame number i+1 in the scene information 501, and its moving image reproduction time is (time i+1)−(time i). The representative image number (503) is information representative of the location of the still image data in the still image file (211), and is a serial number assigned to each still image data, a start address of the still image data, or the like. The representative image is a copy of image data of one frame in the scene stored in the still image file (211) and having the data structure shown in FIG. 4. Although the representative image is generally a copy of the first image of the scene (image data having the frame number i in the scene information 500), it may be a copy of image data at the middle of the scene (image data having the frame number of ((frame number i)+(frame number i+1))/2 in the scene information 504), a copy of image data at the last of the scene (image data having the frame number of (frame number i+1)−1 in the scene information 504), or a copy of other image data. In the example shown in FIG. 5, the scene information is n3 in total number which means that the input moving images are divided into n3 scenes.

Figure 7:
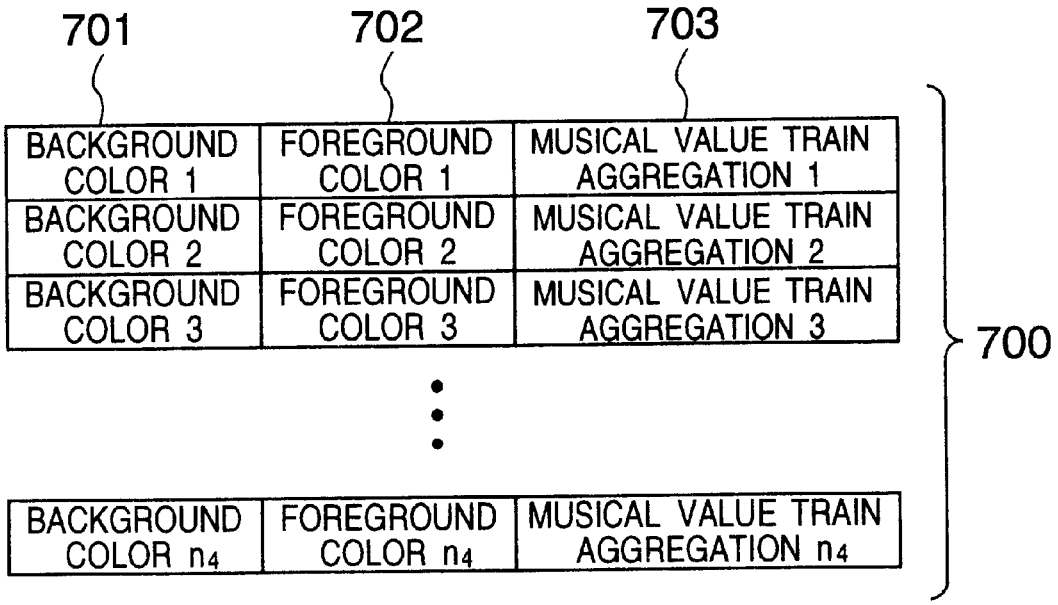
FIG. 7 is an illustrative diagram showing a specific example of sensitivity data stored in a sensitivity database.

Next, the data structure of data stored in the sensitivity database (213) shown in FIG. 2 will be described in detail with reference to FIG. 7. The database stores a number of sensitivity data sets 700. The sensitivity data (700) is constituted of background color information 701 and foreground color information 702 respectively representing a sensitivity feature amount of an image, and a musical value train aggregation 703 representing a sensitivity feature amount of music. The background/foreground color information (701, 702) is constituted of a combination of three real numbers representing red, green, and blue intensities.

Figure 8:
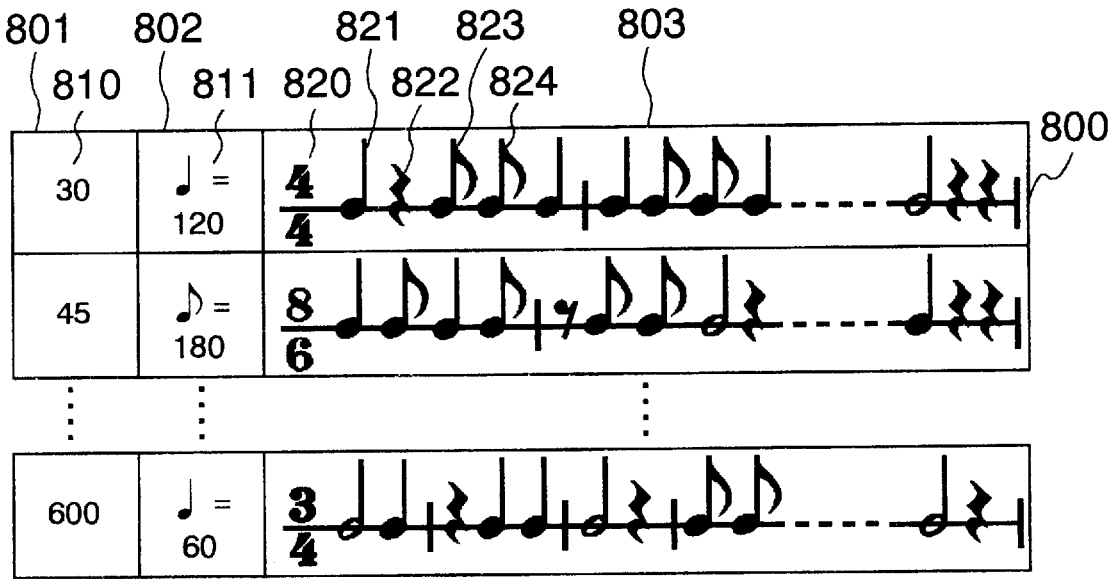
FIG. 8 is an illustrative diagram showing a specific example of musical value train aggregation data contained in sensitivity data.

Next, the data structure of the musical value train aggregation (703) will be described with reference to FIG. 8. The musical value train aggregation is constituted of a plurality of musical value train information sets 800. The musical value train information (800) is constituted of a musical value train 803, tempo information 802 of the musical value train, and time information 801 indicating a time required for playing the musical value train at the tempo. The tempo information (802) is constituted of a reference note and the number of these notes played in one minute. For example, the tempo 811 indicates that a crochet is played 120 times in one minute. More specifically, this tempo (811) is stored in the database as a pair (96, 120) where an integer 96 represents a period of a quarter note and an integer 120 represents the number of notes to be played. The time information is stored as an integer in unit of second. For example, if the tempo (811) is a quarter note=120 and the musical value in the musical value train (803) is 60 quarter notes, then the performance time is a half minute, i.e., 30 seconds so that 30 is stored in the time information (810). The musical value train (803) is constituted of rhythm information 820 and a plurality of musical value information sets (821–824). The rhythm information (820) is information regarding a rhythm of a melody to be played. For example, 820 indicates a rhythm of four-quarter measure and stored in the data base as a pair (4, 4) of two integers. The musical value information (821–824) is constituted of a musical value of note (821, 822, 824) and a musical value of rest (822). By sequentially disposing these musical values, the rhythm of a melody can be expressed. The database stores data in the order of shorter time required to play.

Figure 1:
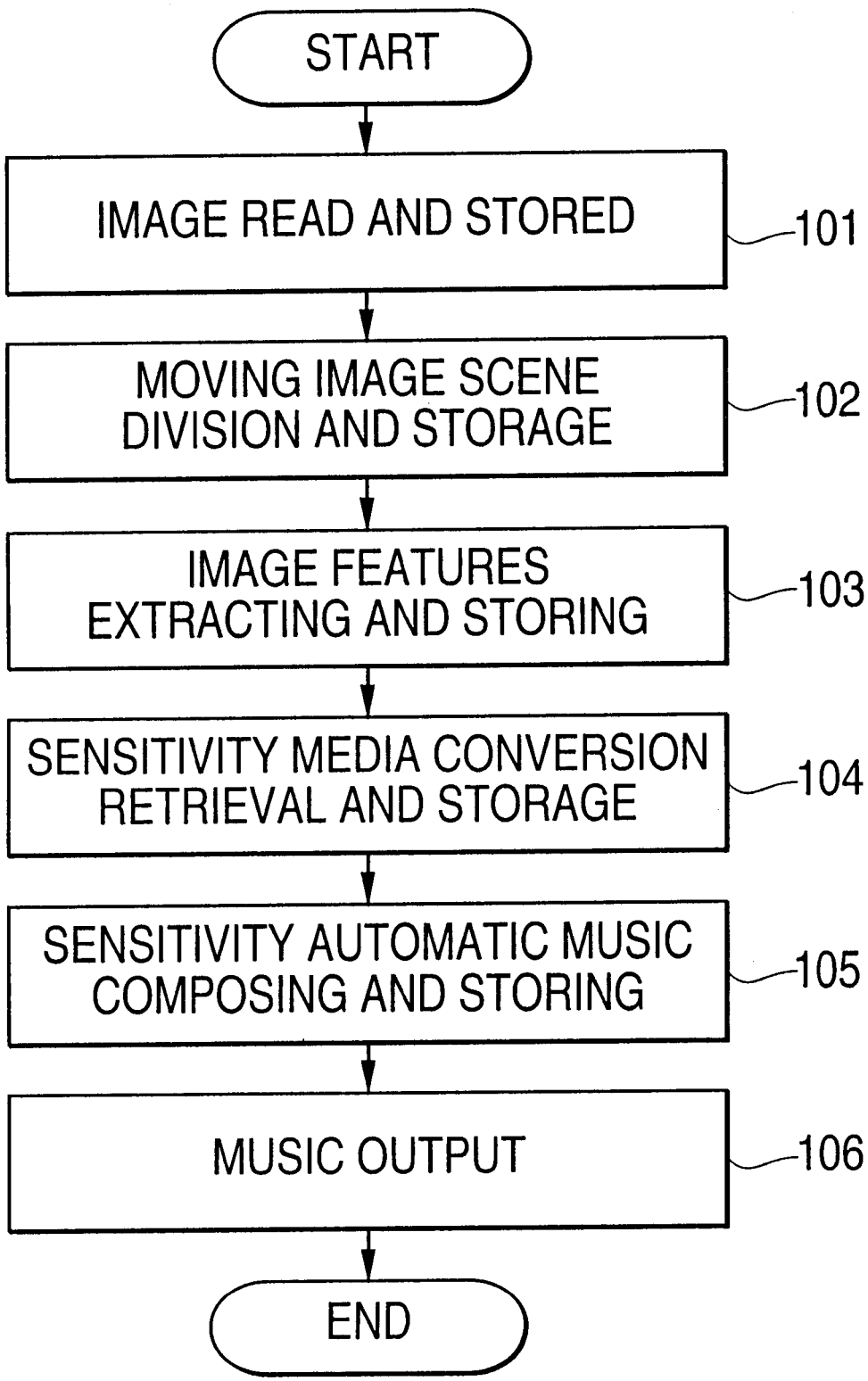
FIG. 1 is a flow chart illustrating one example of a process flow of a method of adding background music to a moving image according to the invention.
Figure 13:
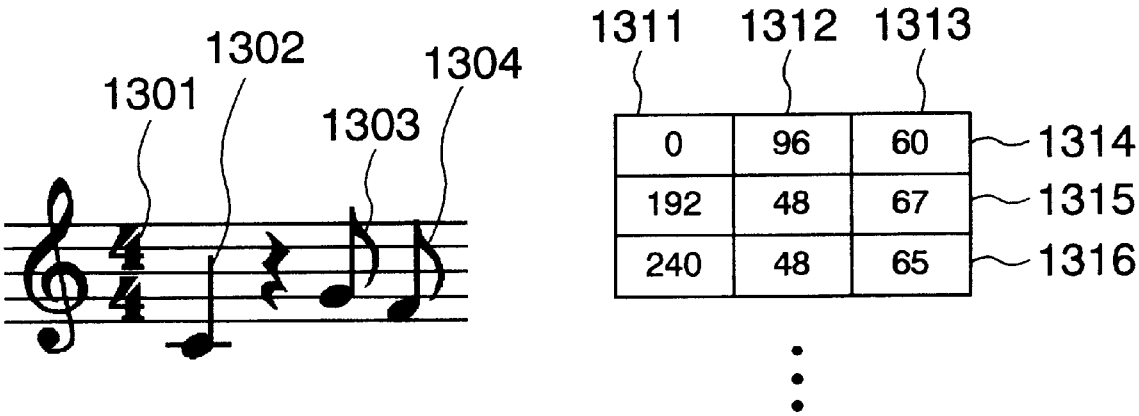
FIG. 13 is an illustrative diagram showing a specific example of background music data generated in accordance with the invention.

FIG. 13 shows an example of background music data stored in the music file (212) by the sensitivity automatic music composing process shown in FIG. 1. Background music is expressed as a train of rhythm information 1301 and notes (1302–1304). The rhythm information (1301) is stored as a pair of two integers similar to the rhythm information (820) of the musical value train aggregation (FIG. 8). The note trains (1301–1304) are stored as three pairs (1314–1316) of integers. The integers represent a tone generation timing 1311, a note period 1312, and a note pitch 1313, respectively.

Next, a method of realizing each process will be described sequentially in the order described in the outline shown in FIG. 1 will be described.

The moving image scene dividing process (102) shown in FIG. 1 can be realized by the method described, for example, in "Automatic Video Indexing and Full-Video Search for Object Appearances", Papers Vol. 33, No. 4, Information Processing Society of Japan and "Moving Image Change Point Detecting Method", JP-A-4-111181. All these methods detect as a scene division point a point where a defined change rate between image data of one frame (300) of a moving image (FIG. 3) and image data of the next frame (310) exceeds a predetermined value. A scene information train (FIG. 5) constituted of the obtained scene division point information and scene representative image information is stored in the memory (206).

Figure 6:
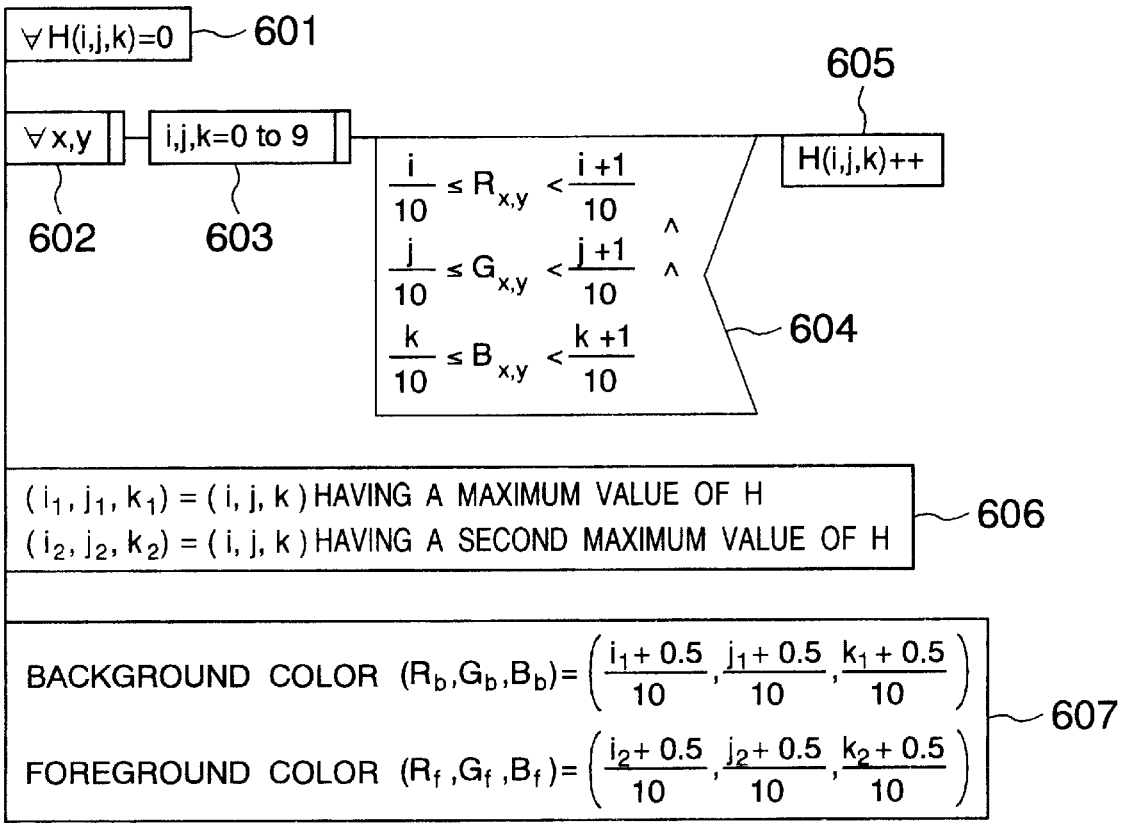
FIG. 6 is a drawing showing an example of an image feature extracting process flow.

The image feature extracting process (103) shown in FIG. 1 will be described with reference to FIG. 6. This process derives the image feature amounts of "background color" and "foreground color" of each still image data stored in the still image file (211 of FIG. 2) by executing the following processes. Basically, colors are separated into 1000 sections of 10×10×10, and the number of points in an image having a corresponding color section is counted, and a color having a center value in the section having the maximum number of points is used as the "background color" and a center color in the section having the second maximum number is used as the "foreground color". The process will be described specifically with reference to FIG. 6. First, a data array for a 10×10×10 histogram is prepared, and all data is set to 0 (Step 601). Next, Step 603 is executed for point display information (400) corresponding to each of the X-coordinate (401) and Y-coordinate (402) of image data (FIG. 4) (Step 602). While integers 0 to 9 are sequentially substituted into integer variables i, j, and k, Step 604 is executed (Step 603). If the red, green, and blue intensities of color information of a point corresponding to current X- and Y-coordinates are between i/10 and (i+1)/10, j/10 and (j+1)/10, and k/10 and (k+1)/10, respectively, Step 605 is executed (Step 604) and the corresponding color section histogram value is incremented by 1. Next, indices i, j, and k of a histogram having the maximum value are substituted into variables i1, j1, and k1, and the indices of a histogram having the second maximum value are substituted into variables i2, j2, and k2 (Step 606). Next, a color having the red, green, and blue intensities of (i1+0.5)/10, (j1+0.5)/10, and (k1+0.5)/10 is stored in the memory (206) as the background color, and a color having the red, green, and blue intensities of (i2+0.5)/10, (j2+0.5)/10, and (k2+0.5)/10 is stored in the memory (206) as the foreground color (step 607).

Figure 9:
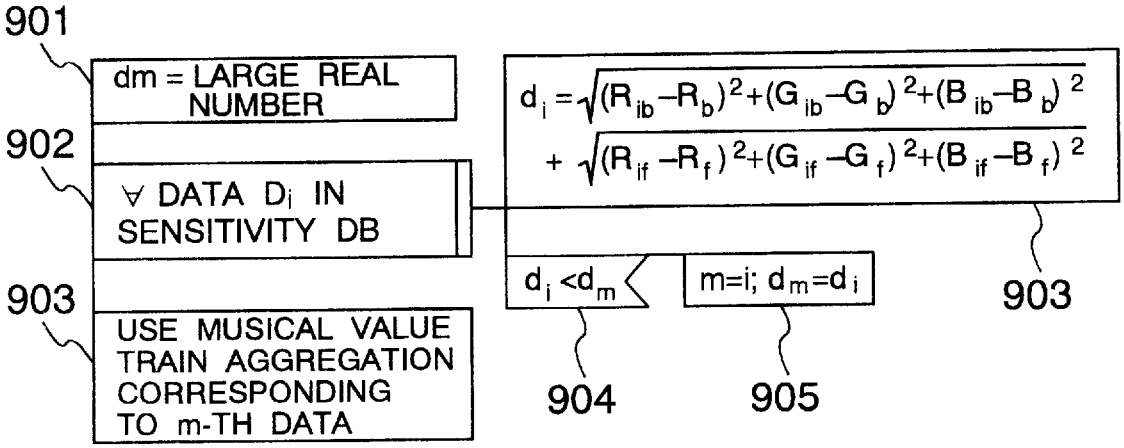
FIG. 9 is a drawing showing an example of a sensitivity media conversion retrieval process flow.

The sensitivity media conversion retrieving process (104) shown in FIG. 1 will be described with reference to FIG. 9. This process obtains sensitivity data corresponding to background/foreground color nearest to the background/foreground color which is the sensitivity feature amount of image obtained by the image feature extracting process (FIG. 6), and obtains the musical value train aggregation (FIG. 8) which is the sensitivity feature amount of music corresponding to the obtained sensitivity data. The details of this process will be described in the following. First, a sufficiently large real number is substituted into a variable dm (Step 901). Next, Steps 903–904 are executed for all sensitivity data (700) Di stored in the sensitivity database (213) (Step 902). Pythagoras distances between the background color (Rb, Gb, Bb) obtained by the image feature extracting process and Di background color (Rib, Gib, Bib) and between the foreground color (Rf, Gf, Bf) obtained by the image feature extracting process and Di foreground color (Rif, Gif, Bif), (respective values are assumed to be coordinates in a three-dimensional space), are calculated and a total sum thereof is substituted into a variable di (Step 904). If di is smaller than dm, Step 905 is executed (Step 904). The current sensitivity data index i is substituted into a variable m, and di is substituted into dm (Step 905). Lastly, the :musical value train aggregation corresponding to the sensitivity data having the variable m index is stored in the memory (206) (Step 607).

Next, the sensitivity automatic music composing process (105) in FIG. 1 is accomplished by applying the method described in Japan Patent Application Number 7-237082 "automatic composing method" (filed on Sep. 14, 1995), which was filed in Japan Patent Office by the present inventor, to each scene. The outline of the method is explained using FIG. 10 hereinafter. At first, the appropriate music value train is retrieved from the music value train aggregation (FIG. 8) obtained by the sensitivity media conversion retrieval process (104) using the required time for background music (step 1001). Next, the retrieved music value train is added to the pitch to generate background music (step 1002).

Figure 10:
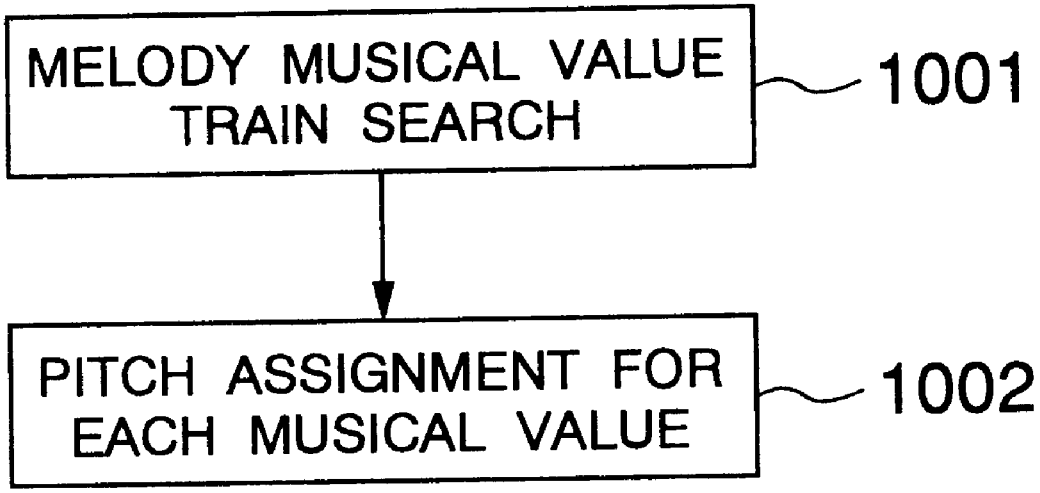
FIG. 10 is a flowchart illustrating an outline of an example of a sensitivity automatic music composing precess flow.
Figure 11:
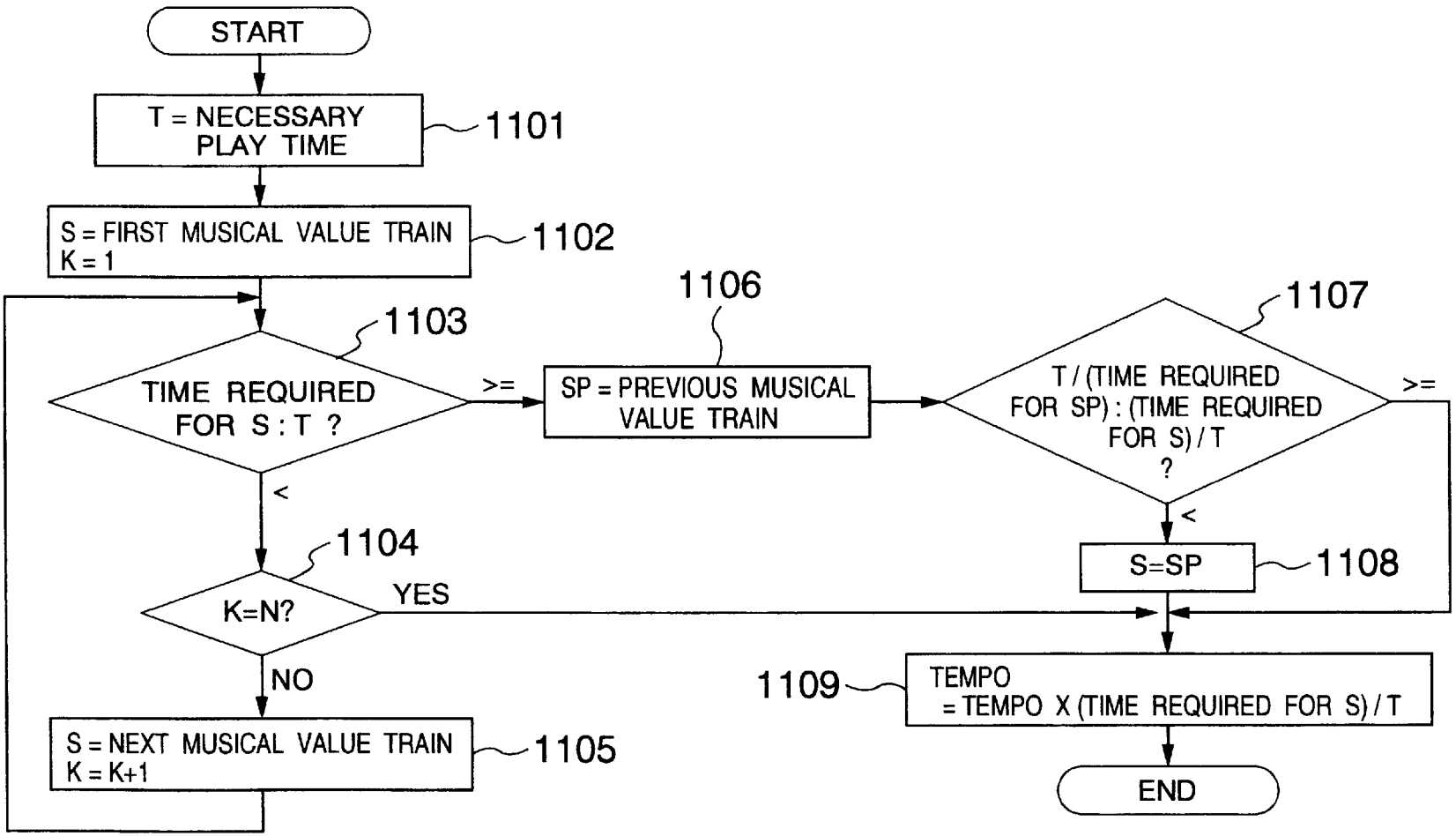
FIG. 11 is a flow chart illustrating an example of a melody musical value series retrieval process flow

A melody musical value train retrieving process (1001) shown in FIG. 10 will be described in detail with reference to FIG. 11. First, stored in a variable T is a reproduction time of the moving image section (if an input image is a moving image) obtained by using the time information (502) in the scene information (500) and output during the moving image scene extracting process (102), or a performance time (if an input image is a still image) input by a user into the memory (206) (Step 1101). Next, the first data in the musical value train aggregation (FIG. 8) is stored in a variable S and an integer "1" is stored in a variable K (Step 1102). Next, time information (801) of a time required for playing the data S is compared with the value T. If T is longer, Step 1104 is executed, whereas if the time for S is longer or equal, Step 1106 is executed (Step 1103). If the variable K is equal to the number N of musical value trains in the musical value train aggregation, Step 1109 is executed, whereas if not, Step 1105 is executed (Step 1104). The next data in the musical value train aggregation is stored in S, and the variable value K is incremented by 1 to return to Step 1103 (Step 1105). The musical value train data one data before the data stored in S is stored in a variable SP (Step 1106). Next, a ratio of the variable value T to the time information (801) for the data SP is compared with a ratio of the time information (801) for the data S to the variable value T, and if equal or if the former is larger, Step 1109 is executed, whereas if the latter is larger, Step 1108 is executed (Step 1108). The value of the tempo (802) stored in the data S is changed to a value multiplied by the ratio of the time information (801) for the data S to the variable value T, and the data S is stored in the memory (206) as the musical value train data to terminate the process (Step 1109). By executing this process, a note train having a time nearest to a given time required for musical performance can be searched. In addition, by adjusting the tempo, the searched musical value train has a time equal to the given time.

Figure 12:
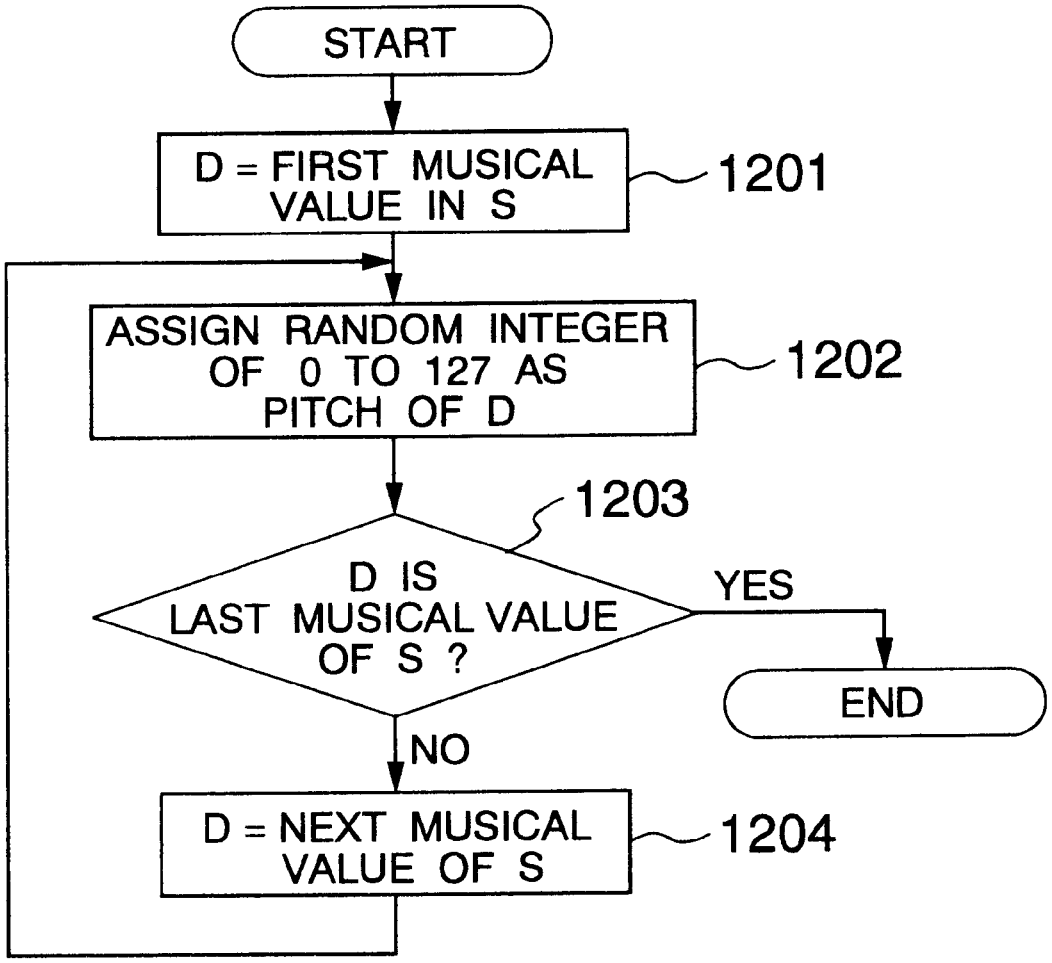
FIG. 12 is a flowchart illustrating an example of a pitch assign process flow for each musical value.

Next, a pitch assigning process (1002) shown in FIG. 10 will be described in detail with reference to FIG. 12.

First, the first musical value information in the musical value train information S stored in the memory (206) is set to a variable D (Step 1201). Next, a random integer from the minimum pitch value 0 to the maximum pitch value 127 is obtained and assigned to D (Step 1202). Next, if the musical value stored in D is the last musical value of S, the process is terminated, whereas if not the last musical value, Step 1204 is executed (Step 1203). The next musical value in S is set to D (Step 1204). In the above manner, background music generated and stored in the memory (206) L is stored in the music file (212) and the process is terminated.

The relationship between the system and an image source to which background music is added will be described. In the above description, the moving image is used as the image source. Even if the image source is a still image, the invention can be applied.

For example, if an image added background music is one or more still images such as used for presentation, Steps 101, 103 to 106 are executed to add background music to the images. Images provided with BGM may be one or more still images such as computer graphics generated by the processor (205) and stored in the still image file (211). In this case, background music is given by executing Steps 103 to 106. However, in adding background music to the still images, a user enters from the input device (204) the performance time information of background music for each still image which time information is stored in the memory (206). The invention is also applicable to the case wherein a time when a still image needing background music is input is measured, one still image is assumed as one scene, and the time until the next still image is input is used as the time duration of the scene.

As another embodiment, the data format of the image data of the moving image file (210 in FIG. 1) and the data format of a representative image of the still image data (211 in FIG. 1) may be changed. Since the still image data is required by itself to constitute one image, it is necessary to store data of all the (X,Y) coordinates. However, image data in the moving image file except the image data of the first frame of the scene is essentially similar to image date of previous frames. Therefore, difference data therebetween may be stored as the image data.

Figure 14:
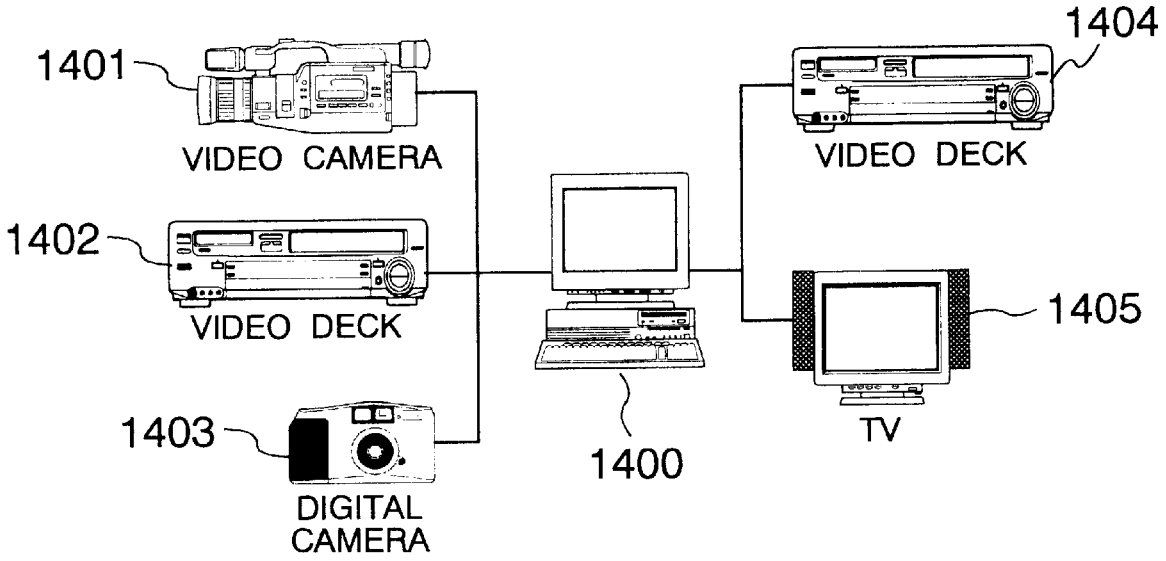
FIG. 14 is a diagram illustrating an example of a product type realized by the method of the present invention.

Lastly, an example of a product type realized by using the method of the invention will be described with reference to FIGS. 2 and 14. This product uses a video camera (1401), a video deck (1402) or a digital camera (1403) as the image input device (201), a video deck (1404) or a television (1405) as the image and music output device (202, 203), and a computer (1400) as the other devices (204–206, 210–213). If the video camera (1401) is used for inputting an image, the video camera supplies the moving image file (210) in the computer (1400) with photographed video images as the moving image information. If the video deck (1402) is used, the video deck reproduces the video information stored in a video tape, and inputs it as the moving image information into the moving image file (210) in the computer (1400). If the digital camera (1403) is used, the digital camera supplies the still image file (211) of the computer (1400) with one or more photographed still images. If the video deck (1404) is used for outputting an image and music, the video deck records and stores, at the same time in a video tape, video information of moving images (if a moving image is input) stored in the moving image file (210) or still images (if a still image is input) stored in the still image file (211), and acoustic information of music stored in the music file (212). If the television (1405) is used, the television outputs at the same time video information of moving images (if a moving image is input) stored in the moving image file (210) or still images (if a still image is input) stored in the still image file (211), and acoustic information of music stored in the music file (212). The video deck (1402) used for inputting an image and a video deck (1404) used for outputting an image and music may be the same video deck.

According to the present invention, it is possible to provide an automatic music composing system capable of automatically composing background music suitable for the atmosphere and reproduction time of an externally supplied moving or changing image a video editing system including such an automatic music composing system, and a multimedia production generation support system.

As described so far, the automatic music composing technology of the invention is suitable, for example, for generating BGM for presentation using a plurality of OHP's, for adding background music to a video image recorded by a user in the video editing system, and for generating background music in a multimedia production generation support system. The invention is also applicable to personal computer software by storing various programs and databases which reduces the invention into practice.

What is claimed is:

1. A method of automatically composing background music for a moving image comprising the steps of:

dividing the moving image into a plurality of scenes;

obtaining a reproduction time and representative image for each scene;

selecting a musical value train from a previously stored musical value train group in accordance with a feature value of the representative image and the reproduction time;

assigning a pitch for each musical value in the selected musical value train to compose music; and adjusting tempo of the music in accordance with the reproduction time to output the music with the scene.

2. A method according to claim 1, wherein the feature value comprises a background color and a foreground color of the representative image, and wherein the musical value train selection comprises extracting, from a plurality of predetermined combinations of sets of background colors and foreground colors and corresponding musical value train groups, the musical value train group corresponding to the set consisting of the background color and the foreground color nearest to the background color and the foreground color of the representative image, and selecting the musical value train having the nearest reproduction time from the extracted musical value train group.

3. A method according to claim 1, wherein the pitch is assigned using a random number.

4. A method according to claim 1, wherein the musical value train includes musical value information, tempo information, and time required to play.

5. A method of automatically composing background music for a moving image comprising the steps of:

obtaining a reproduction time and a background color and a foreground color of representative image of the moving image;

extracting, from a plurality of predetermined combinations of sets of background colors and foreground colors and corresponding musical value train groups, the musical value train group corresponding to the set consisting of the background color and foreground color nearest to the background color and foreground color of the representative image;

selecting the musical value train having the nearest reproduction time from the extracted musical value train group, and adjusting tempo of the musical value train in accordance with the reproduction time; and assigning a pitch for each musical value in the selected musical value train to compose music.

6. A method according to claim 5, wherein the pitch is assigned by using a random number.

7. A method according to claim 5, wherein the musical value train includes musical value information, tempo information, and time required to play.

8. A music composing program for automatically composing background music for a moving image, the program comprising performing the steps of:

dividing the moving image into a plurality of scenes;

obtaining a reproduction time and representative image for each scene;

selecting a musical value train from a previously stored musical value train group in accordance with a feature value of the representative image and the reproduction time;

assigning a pitch for each musical value in the selected musical value train to compose music; and adjusting tempo of the music in accordance with the reproduction time to output the music with the scene.

9. A music composing program according to claim 8, wherein the feature value comprises a background color and a foreground color of the representative image, and wherein the musical value train selection comprises extracting, from a plurality of predetermined combinations of sets of background colors and foreground colors and corresponding musical value train groups, the musical value train group corresponding to the set consisting of the background color and the foreground color nearest to the background color and the foreground color of the representative image, and selecting the musical value train having the nearest reproduction time from the extracted musical value train group.

10. A music composing program according to claim 8, wherein the pitch is assigned by using a random number.

11. A music composing pro gram according to claim 8, wherein the musical value train includes musical value information, tempo information, and time required to play.

12. A music composing program embodied in a tangible medium for automatically composing background music for a moving image, the program comprising the method steps of:

obtaining a reproduction time and a background color and a foreground color of a representative image of the moving image;

extracting, from a plurality of predetermined combinations of sets of background colors and foreground colors and corresponding musical value train groups, a musical value train group corresponding to the set consisting of the background color and the foreground color nearest to the background color and the foreground color of the representative image;

selecting the musical value train having the nearest reproduction time from the extracted musical value train group, and adjusting tempo of the musical value train in accordance with the reproduction time; and assigning a pitch for each musical value in the selected musical value train to compose music.

13. A music composing program according to claim 12, wherein the pitch is assigned by using a random number.

14. A music composing program according to claim 12, wherein the musical value train includes musical value information, tempo information, and time required to play.

15. A method of automatically composing background music for a changing image comprising the steps of:

dividing the changing image into a plurality of scenes;

obtaining a reproduction time and representative image for each scene;

selecting a musical value train from a previously stored musical value train group in accordance with a feature value of the representative image and the reproduction time;

assigning a pitch for each musical value in the selected musical value train to compose music; and adjusting tempo of the music in accordance with the reproduction time to output the music with the scene.

16. A method according to claim 15, wherein the feature value comprises a background color and a foreground color of the representative image, and wherein the musical value train selection comprises extracting, from a plurality of predetermined combinations of sets of background colors and foreground colors and corresponding musical value train groups, the musical value train group corresponding to the set consisting of the background color and the foreground color nearest to the background color and the foreground color of the representative image, and selecting the musical value train having the nearest reproduction time from the extracted musical value train group.

17. A method according to claim 15, wherein the pitch is assigned using a random number.

18. A method according to claim 15, wherein the musical value train includes musical value information, tempo information, and time required to play.

19. A method of automatically composing background music for a changing image comprising the steps of:

obtaining a reproduction time and a background color and a foreground color of representative image of the changing image;

extracting, from a plurality of predetermined combinations of sets of background colors and foreground colors and corresponding musical value train groups, the musical value train group corresponding to the set consisting of the background color and foreground color nearest to the background color and foreground color of the representative image;

selecting the musical value train having the nearest reproduction time from the extracted musical value train group, and adjusting tempo of the musical value train in accordance with the reproduction time; and assigning a pitch for each musical value in the selected musical value train to compose music.

20. A method according to claim 19, wherein the pitch is assigned by using a random number.

21. A method according to claim 19, wherein the musical value train includes musical value information, tempo information, and time required to play.

22. A music composing program for automatically composing background music for a changing image, the program comprising performing the steps of:

dividing the changing image into a plurality of scenes;

obtaining a reproduction time and representative image for each scene;

selecting a musical value train from a previously stored musical value train group in accordance with a feature value of the representative image and the reproduction time;

assigning a pitch for each musical value in the selected musical value train to compose music; and adjusting tempo of the music in accordance with the reproduction time to output the music with the scene.

23. A music composing program according to claim 22, wherein the feature value comprises a background color and a foreground color of the representative image, and wherein the musical value train selection comprises extracting, from a plurality of predetermined combinations of sets of background colors and foreground colors and corresponding musical value train groups, the musical value train group corresponding to the set consisting of the background color and the foreground color nearest to the background color and the foreground color of the representative image, and selecting the musical value train having the nearest reproduction time from the extracted musical value train group.

24. A music composing program according to claim 22, wherein the pitch is assigned by using a random number.

25. A music composing program according to claim 22, wherein the musical value train includes musical value information, tempo information, and time required to play.

26. A music composing program embodied in a tangible medium for automatically composing background music for a changing image, the program comprising the method steps of:

obtaining a reproduction time and a background color and a foreground color of a representative image of the changing image;

extracting, from a plurality of predetermined combinations of sets of background colors and foreground colors and corresponding musical value train groups, a musical value train group corresponding to the set consisting of the background color and the foreground color nearest to the background color and the foreground color of the representative image;

selecting the musical value train having the nearest reproduction time from the extracted musical value train group, and adjusting tempo of the musical value train in accordance with the reproduction time; and assigning a pitch for each musical value in the selected musical value train to compose music.

27. A music composing program according to claim 26, wherein the pitch is assigned by using a random number.

28. A music composing program according to claim 26, wherein the musical value train includes musical value information, tempo information, and time required to play.

* * * * *